US006076477A

United States Patent [19]

Badillo

[11] Patent Number: 6,076,477

[45] Date of Patent: Jun. 20, 2000

[54] HOOK SYSTEM FOR SEWING MACHINE

[76] Inventor: Paul Badillo, 7544 Dawn Dr., Littleton, Colo. 80125

[21] Appl. No.: 09/316,444

[22] Filed: May 21, 1999

[51] Int. Cl.[7] ..... D05B 57/26

[52] U.S. Cl. ..... 112/231

[58] Field of Search ..... 112/231, 230, 112/188, 181, 189, 190, 191

[56] References Cited

U.S. PATENT DOCUMENTS

| | | | |
|---|---|---|---|
| Re. 33,879 | 4/1992 | Shimizu . | |
| 4,108,095 | 8/1978 | Kohara | 112/230 |
| 4,858,543 | 8/1989 | Badillo . | |
| 5,109,783 | 5/1992 | Shimizu . | |
| 5,152,236 | 10/1992 | Hirose et al. . | |
| 5,158,029 | 10/1992 | Hirose . | |
| 5,168,826 | 12/1992 | Hirose . | |
| 5,188,046 | 2/1993 | Badillo . | |
| 5,351,636 | 10/1994 | Hirose . | |
| 5,375,544 | 12/1994 | Badillo . | |
| 5,413,058 | 5/1995 | Hirose et al. . | |
| 5,474,004 | 12/1995 | Badillo . | |
| 5,598,799 | 2/1997 | Badillo . | |
| 5,617,803 | 4/1997 | Badillo . | |
| 5,651,323 | 7/1997 | Hirose et al. . | |
| 5,921,192 | 7/1999 | Badillo | 112/231 |

*Primary Examiner*—Ismael Izaguirre
*Attorney, Agent, or Firm*—Wood, Phillips, VanSanten, Clark & Mortimer

[57] ABSTRACT

A hook system for a sewing machine having a hook assembly with a first operating axis, a bobbin basket assembly which is mounted to the hook assembly for movement relative to the hook assembly around the first operating axis, and a bobbin case assembly which is mounted on and separable from the bobbin basket assembly and defines at least a part of a receptacle for a bobbin. The bobbin case assembly has a peripheral wall extending around the first operating axis and a confining wall extending from the peripheral wall. The peripheral wall and confining wall have a combined mass. At least 50% of the combined mass of the peripheral wall and confining wall is made from a non-metal material.

26 Claims, 4 Drawing Sheets

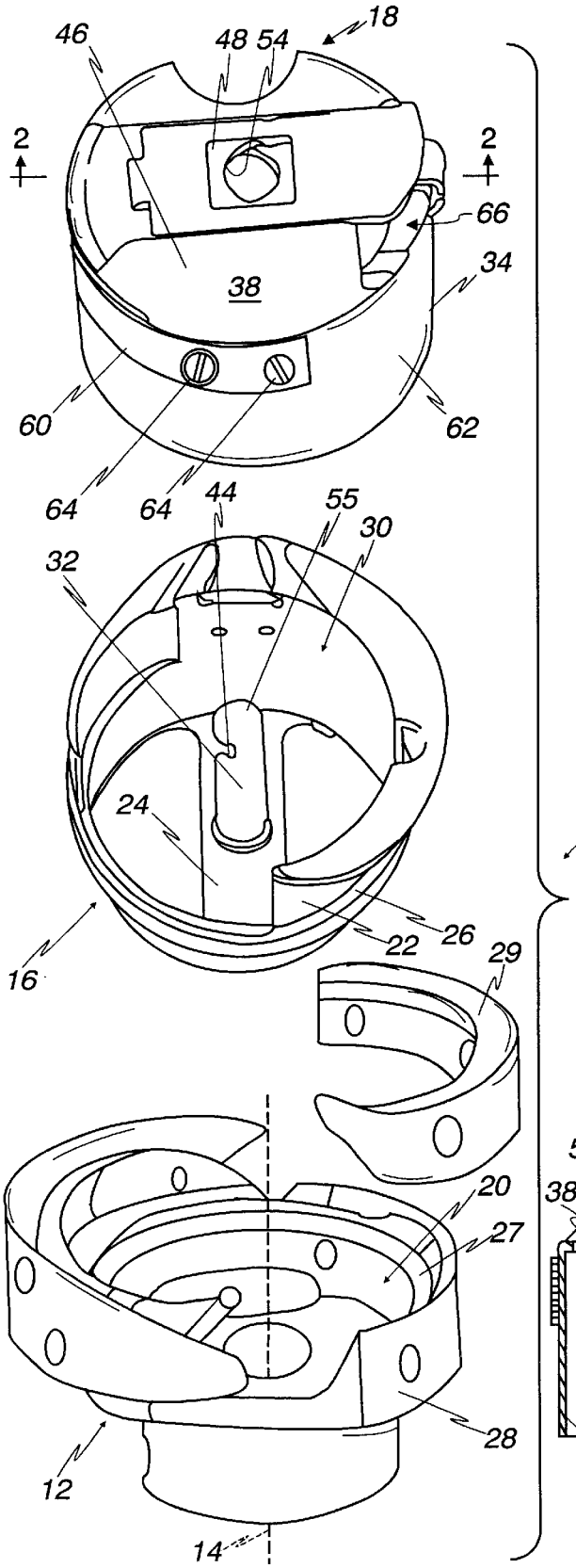
Fig. 1
Fig. 2
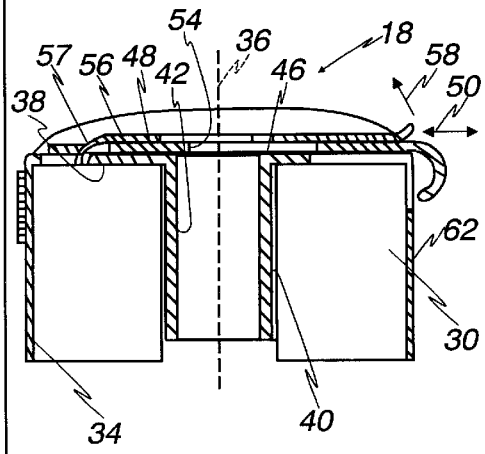

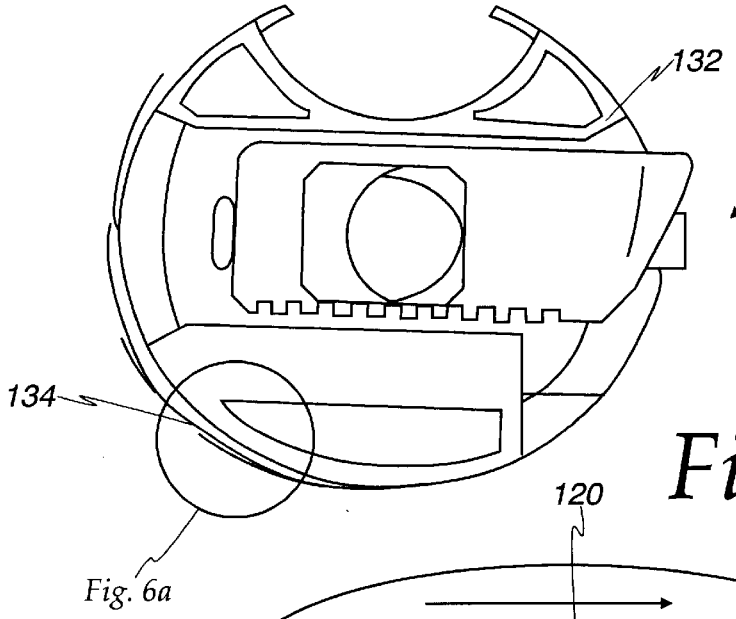
Fig. 6
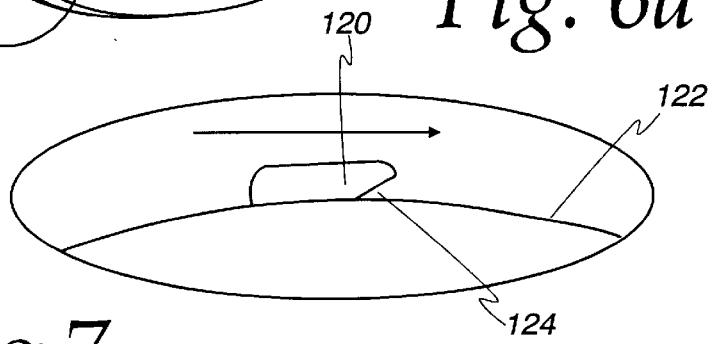
Fig. 6a
Fig.7
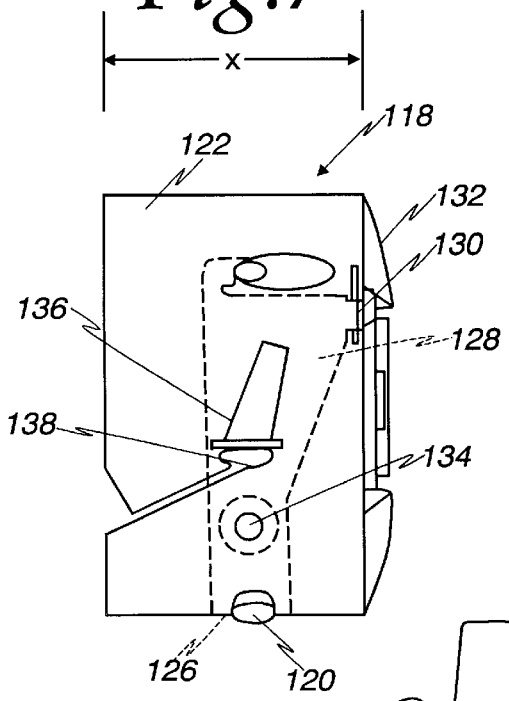
Fig.8
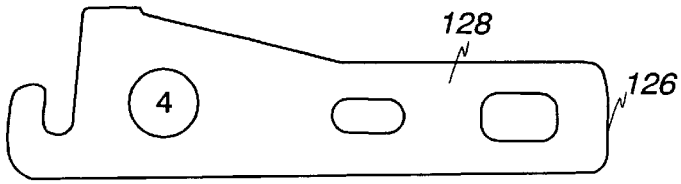

HOOK SYSTEM FOR SEWING MACHINE

FIELD OF THE INVENTION

This invention relates to sewing machines, and more particularly, to a hook system for use on sewing machines.

BACKGROUND ART

In one known hook system, a bobbin case assembly and bobbin basket assembly cooperatively define a receptacle for a bobbin and are fully separable, each from the other. The bobbin basket assembly and bobbin case assembly are operatively connected to a hook assembly having an operating axis. The bobbin basket assembly has a peripheral wall with a radially outwardly projecting bearing rib thereon which is guided in a complementary raceway defined by the hook assembly. In operation, the hook assembly is rotated at high speed. Ideally, the bearing rib rides smoothly within the raceway at these high speeds.

It is known to make both the bobbin basket assembly and bobbin case assembly from metal to maximize durability and minimize wear. At high operating speeds, friction may be generated between the metal bobbin basket assembly and hook assembly that generates heat sufficient to cause part expansion that may result in binding of the bearing rib on the bobbin basket assembly within the raceway of the hook assembly.

Further, if there is improper alignment between the bobbin basket assembly and hook assembly, or the hook assembly is out of dynamic balance, damage may be inflicted, one to the other, by the bobbin basket assembly and hook assembly.

To address, among other things, the above problems, the inventor herein devised rotary hook systems with non-metallic bobbin basket assemblies. This has resulted in a substantial weight reduction which has contributed to overall improved sewing performance. However, to the knowledge of the inventor herein, bobbin case assemblies are, to this day, made primarily from metal. The metal bobbin case assembly has a sufficient weight that it potentially detracts from performance.

Further, the metal case assembly does not lend itself to being formed into intricate shapes in an economical manner.

The above problems are contended with both in systems which use a hook assembly that rotates continuously in one direction and those which use an oscillating hook assembly.

SUMMARY OF THE INVENTION

In one form of the invention, a hook system for a sewing machine is provided having a hook assembly with a first operating axis, a bobbin basket assembly which is mounted to the hook assembly for movement relative to the hook assembly around the first operating axis, and a bobbin case assembly which is mounted on and separable from the bobbin basket assembly and defines at least a part of a receptacle for a bobbin. The bobbin case assembly has a peripheral wall extending around the first operating axis and a confining wall extending from the peripheral wall. The peripheral wall and confining wall have a combined mass. At least 50% of the combined mass of the peripheral wall and confining wall is made from a non-metal material.

Substantially the entirety of the combined mass of the peripheral wall and confining wall may be made from a non-metal material.

In one form, the bobbin basket assembly and bobbin case assembly cooperatively define a receptacle for a bobbin.

The bobbin case assembly may further include a thread holding spring element attached to the peripheral wall of the bobbin case assembly.

The spring element may be curved and wrap around a part of the peripheral wall of the bobbin case assembly.

The bobbin case assembly may further include a latch system with a latch element that is movable relative to the peripheral and confining walls between a) a latched position wherein the latch element maintains the bobbin case assembly operatively connected to the bobbin basket assembly and b) an unlatched position wherein the bobbin case assembly can be selectively assembled to and separated from the bobbin basket assembly.

The latch element may be translatable between the latched and unlatched positions.

The latch element may be made from metal.

The latch system may include a latch element actuator that is pivotable to change the latch element from the latched position into the unlatched position. The latch element actuator may be made from metal.

In one form, the non-metal material is plastic. The non-metal material may be polyketone or material sold commercially under at least one of the trademarks DELRIN™ and PEAK™.

The spring element may likewise be made from metal.

The spring element may further have a finger which projects into one of the peripheral wall and the confining wall.

In one form, the peripheral and confining walls each have a thickness and the entire thickness of at least a part of at least one of the peripheral wall and confining wall is made from the non-metal material.

The at least part of the at least one of the peripheral wall and confining wall made from the non-metal material may be made by injection molding.

The invention is also directed to a bobbin case assembly that can be separably connected to a hook assembly. The bobbin case assembly has a peripheral wall extending around a first operating axis and a confining wall extending radially relative to the first operating axis from the peripheral wall. The peripheral wall and confining wall have a combined mass. At least 50% of the combined mass of the peripheral wall and confining wall is made from a non-metal material.

Substantially the entirety of the mass of the peripheral wall and confining wall may be made from a non-metal material.

The non-metal material may be at least one of polyketone and a material sold commercially under at least one of the trademarks DELRIN™ and PEAK™.

In one form, the bobbin case assembly has a latch system with a latch element that is movable relative to the peripheral and confining walls between a) a latched position wherein the latch element is capable of maintaining the bobbin case assembly operatively connected to a hook assembly and b) an unlatched position wherein the bobbin case assembly can be selectively assembled to and separated from a hook assembly.

The latch element may be made from metal or a non-metal material.

In one form, the peripheral wall has an axial extent parallel to the first operating axis and the bobbin case assembly has a curved spring element which wraps around a part of the peripheral wall of the bobbin case assembly and extends over at least one half of the axial extent of the peripheral wall.

A wear element may be embedded in the non-metal material, with the wear element being made from a material that is harder than the non-metal material to avoid thread wear in operation.

The bobbin case assembly may further include a thread holding spring element which wraps around a part of the peripheral wall of the bobbin case assembly, with there being a track on the peripheral wall extending radially with respect to the first rotary axis to facilitate confining of thread between the peripheral wall and spring element.

The peripheral wall has axially spaced ends. In one form, there is a thread receiving opening extending fully through the peripheral wall that is located approximately mid-way between the axially spaced ends of the peripheral wall.

In one form, there is a slot extending through the peripheral wall from one axially spaced end to the thread receiving opening and the slot does not extend significantly past the thread receiving opening toward the other axially spaced end of the peripheral wall.

BRIEF DESCRIPTION OF THE DRAWINGS

FIG. 1 is an exploded, perspective view of a hook system, according to the present invention, and including a hook assembly, a bobbin basket assembly, and a bobbin case assembly;

FIG. 2 is a cross-sectional view of the bobbin case assembly taken along line 2—2 of FIG. 1;

FIG. 6 is a plan view of a still further modified form of bobbin case assembly, according to the present invention;

FIG. 6*a* is an enlarged, side elevation view of a portion of the bobbin case assembly in FIG. 6 which accepts an end of a thread holding spring element;

FIG. 7 is a side elevation view of the bobbin case assembly in FIGS. 6 and 6*a;*

FIG. 8 is an elevation view of the thread holding spring element on the bobbin case assembly in FIGS. 6–8.

DETAILED DESCRIPTION OF THE DRAWINGS

Figure 3:
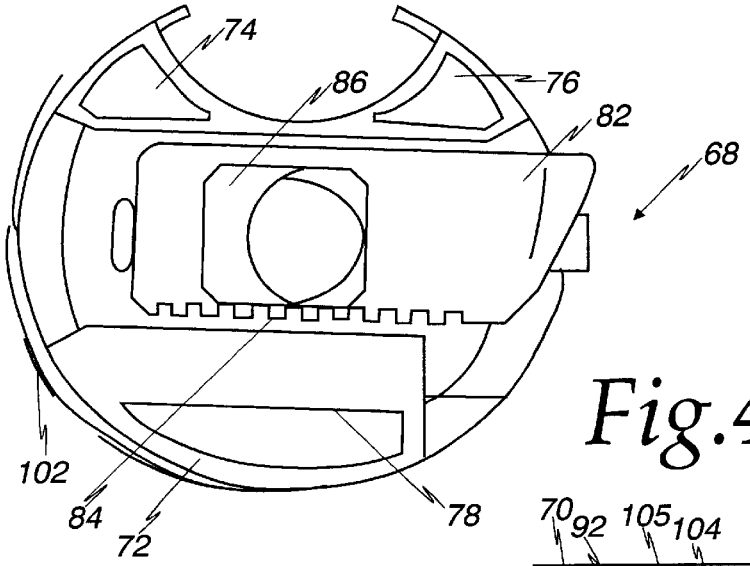
FIG. 3 is a plan view of a modified form of bobbin case assembly, according to the present invention.

In FIG. 1, a rotary hook system, according to the present invention, is shown at 10. The rotary hook system 10 consists of a hook assembly at 12 having an operating axis 14, a bobbin basket assembly at 16, and a bobbin case assembly at 18.

The bobbin basket assembly 16 is mounted in a receptacle 20 defined by the hook assembly 12 for guided movement relative to the hook assembly 12 around the axis 14. The bobbin basket assembly 16 has a peripheral wall 22 extending upwardly from a bottom wall 24 and a curved bearing rib 26 projecting radially outwardly from the peripheral wall 22. The bearing rib 26 moves in a raceway 27 defined by the hook assembly 12, and bounded by a main body 28 and a separable gib element 29, to guide relative rotational movement between the hook assembly 12 and bobbin basket assembly 16.

The peripheral wall 22 on the bobbin basket assembly 16 bounds a receptacle 30 for a thread carrying bobbin (not shown). The bobbin is supported for rotation on a center post 32 projecting upwardly from the bottom wall 24 and through the bobbin.

The receptacle 30 is dimensioned to also receive the bobbin case assembly 18. The bobbin case assembly 18 has a peripheral wall 34 extending around a central axis 36 that is coincident with the axis 14 with the bobbin case assembly 18, bobbin basket assembly 16, and hook assembly 12 operatively connected to each other. A generally radially extending confining wall 38 spans the top of the peripheral wall 34. The bobbin basket assembly 16 and bobbin case assembly 18 cooperatively define the bobbin receptacle 30.

A sleeve 40 depends from the confining wall 38 and has a through opening 42 to closely receive the center post 32. With the bobbin case assembly 18 within the receptacle 30 and operatively connected to the bobbin basket assembly 16, the center post 32 projects through the through opening 42 sufficiently that a notch 44 thereon is exposed above a part of the upper surface 46 of the confining wall 38. The notch 44 could be at axial locations other than that shown.

A latch system includes a latch element 48 mounted on top of the confining wall 38 for guided translatory movement in the line of the double-headed arrow 50. The latch element 48 is normally spring biased towards a latched position shown in FIGS. 1 and 2, wherein a curved locking rim 54 on the latch element 48 moves into radially overlapping relationship with the through opening 42. By directing the center post 32 into the through opening 42, a rounded head 55 on the center post 32 acts against the locking rim 54 and progressively cams the latch element 48 from right to left in FIGS. 1 and 2. With the bobbin case assembly 18 fully seated in the receptacle 30, the notch 44 on the center post 32 aligns axially with the locking rim 54. The spring biased latch element 48 then shifts into the notch 44 to fix the axial relationship between the bobbin basket assembly 16 and bobbin case assembly 18.

When it is desired to separate the bobbin case assembly 18 from the bobbin basket assembly 16, an actuator 56 on the latch system, having an offset end 57 extending through the latch element 48, is pivoted in the direction of the arrow 58, as an incident of which the latch element 48 is driven from right to left in FIG. 2 to an unlatched position, wherein the locking rim 54 is moved out of the notch 44, thereby allowing axial separation of the bobbin basket assembly 16 and bobbin case assembly 18.

The bobbin case assembly 18 further has a thread holding spring element 60 thereon. The spring element 60 is curved and wraps around a part of the outer surface 62 of the peripheral wall 34 of the bobbin case assembly 18. The spring element 60 is maintained on the peripheral wall 34 by screw fasteners 64. Details of construction of suitable spring elements 60 are described with respect to the embodiments in FIGS. 3–8, below.

In the embodiment shown in FIGS. 1 and 2, the peripheral wall 34 and confining wall 38 have a combined mass. The mass, as used herein, is the actual volume occupied by the peripheral wall 34 and confining wall 38. At least 50% of the combined mass of the peripheral wall 34 and confining wall 38 is made from a non-metal material. In one form, substantially the entirety of the combined mass of the peripheral wall 34 and confining wall 38 is made from a non-metal material.

The non-metal material may be plastic. Suitable materials, which are exemplary only, are polyketone and materials sold commercially under the trademarks DELRIN™ and PEAK™.

It is possible to form part or all of the peripheral wall 34 and confining wall 38 by an injection molding process. The full thickness of at least part of at least one of the peripheral wall 34 and confining wall 38 may be made from the non-metal material through injection molding, or otherwise. Injection molding lends itself to economic formation of relatively intricate shapes.

By reason of making part or all of the peripheral wall 34 and confining wall 38 from a non-metal material, the weight of the bobbin case assembly 18 can be reduced in comparison to an all metal construction. Further weight reduction can be accomplished by removing unnecessary materials such as at a cutout 66.

By reducing weight, good tension control for the thread is facilitated. The overall result may be smoother operation of the rotary hook system 10 compared to counterpart systems using primarily metal parts.

It is also possible to partially or fully embed elements of a dissimilar material, such as ceramic or metal, in the non-metal material. For example, metal threaded elements could be embedded in the peripheral wall 34 to accommodate each of the fasteners 64. Other mounting structure, reinforcing structure, and/or wear resistant structure could be incorporated in similar fashion.

The latch element 48 and actuator 56 may be made from plastic, but more preferably are made from metal. The spring element 60 is preferably made from metal but could likewise be made from other materials.

Figure 4:
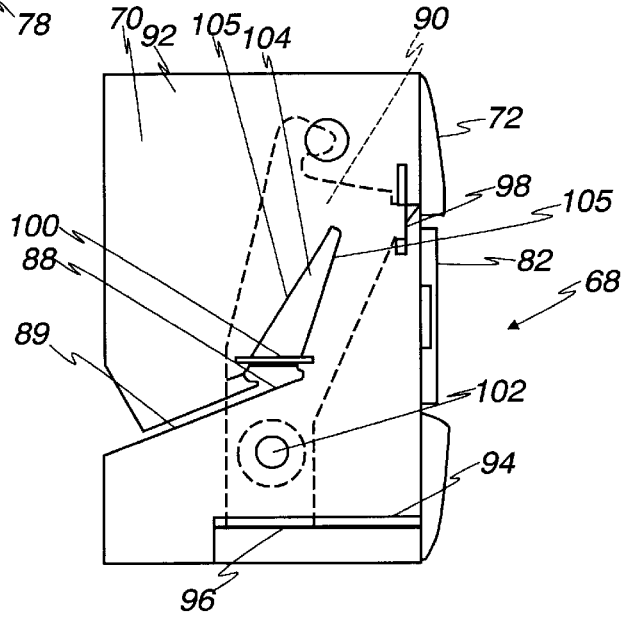
FIG. 4 is a side elevation view of the bobbin case assembly in FIG. 3.

In FIGS. 3 and 4, a modified form of bobbin case assembly is shown at 68. The bobbin case assembly 68 has a peripheral wall 70 and confining wall 72 corresponding to the peripheral wall 34 and confining wall 38. Preferably the peripheral wall 70 and confining wall 72 have the same non-metal composition as described above i.e. at least 50% of the combined mass of the peripheral wall 70 and confining wall 72 is made from a non-metal material, as described above.

To increase weight reduction, strategically located cutouts 74, 76, 78 are formed in the peripheral wall 70 and confining wall 72.

In this embodiment, the element 82, corresponding to the actuator 56, has a serrated thread cutting edge 84 formed thereon. The operation and benefits of this cutting edge 84 are described fully in my co-pending application Ser. No. 09/010,888, now U.S. Pat. No. 5,921,192, entitled "Bobbin Assembly With Structure for Severing Improperly Routed Thread", which is incorporated herein by reference.

Underlying the actuator 82 is a slidable latch element 86, which is spring biased and configured to cooperate with the center post 32 in the same manner as described for the latch element 48.

The elements 82, 86 may both be made from a non-metal material but are more preferably made from metal.

The peripheral wall 70 has a thread receiving opening 88 therethrough adjacent the midpoint between axial spaced ends of the peripheral wall 70 to provide good thread spooling and for reduced localized thread wear. A slot 89 extends from one axial end of the peripheral wall 70 up to but not beyond the opening 88.

A thread holding spring element 90 has a curved shape and is attached to the outer surface 92 of the peripheral wall 70. A slot 94 is formed through the peripheral wall 70. An offset end 96 of the spring element 90 is slidable into the slot 94, obviating the need for a set screw as is commonly used in prior art constructions. A radially extending locking finger 98, on the end of the spring element 90 remote from the end 96, is radially extended into the peripheral wall 70 and/or confining wall 72, or otherwise suitably anchored to the confining wall 72, so as to prevent unwanted movement of the spring element 90 relative to the peripheral wall 70 and confining wall 92.

A ceramic pin 100 is embedded in the peripheral wall 70 at the thread opening 88. The pin 100 is made from a ceramic material, or other material that is harder than the material defining the peripheral wall 70, to avoid thread wear at that location.

A tension screw 102 is provided to set the spring element 90.

A radially extending, molded, bobbin thread track 104 is formed in the peripheral wall 70 to define edges 105, which enhance captive holding of thread between the peripheral wall 70 and spring element 90.

Figure 5:
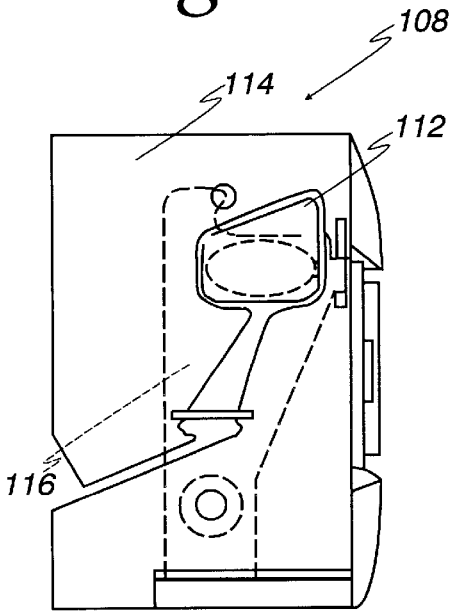
FIG. 5 is a side elevation view of a further modified form of bobbin case assembly, according to the present invention.

In FIG. 5, a modified form of bobbin case assembly, according to the present invention, is shown at 108. The bobbin case assembly 108 is similar in construction to the bobbin case assembly 68, with the primary difference being that a radially facing pressure area 112 is formed in a peripheral wall 114 to potentially permit more positive capture of thread from a bobbin between the peripheral wall 114 and a thread holding spring element 116, to thereby afford good tension control.

In FIGS. 6–8, a further modified form of bobbin case assembly, according to the present invention, is shown at 118. The bobbin case assembly 118 is similar to the bobbin case assembly 108, with primarily the following differences. A securing stud 120 is formed on a peripheral wall 122 so as to define an undercut 124 to accept an end 126 of a thread holding spring element 128. The spring element 128 can be directed into the undercut 124 after which a finger 130, corresponding to the finger 98, is directed into the peripheral wall 122 and/or a confining wall 132. A tension screw 134 can then be directed into the peripheral wall 122 to set the tension for the spring element 128. The direction of the opening of the undercut 124 is shown in FIG. 6*a* relative to a thread track 136.

The spring element 128, like the spring element 110, is longer in the axial direction than is conventional. In a preferred form, the axial extent of the spring element 128 is no less than 50% of the dimension X of the peripheral wall 122 between spaced axial ends. With this configuration, the spring element 128 covers the thread area in the vicinity of the centrally located thread opening 138, corresponding to the thread opening 88 in configuration and location. This provides smooth spooling out by reason of the fact that the thread is applied to the bobbin in a central location.

Figure 9:
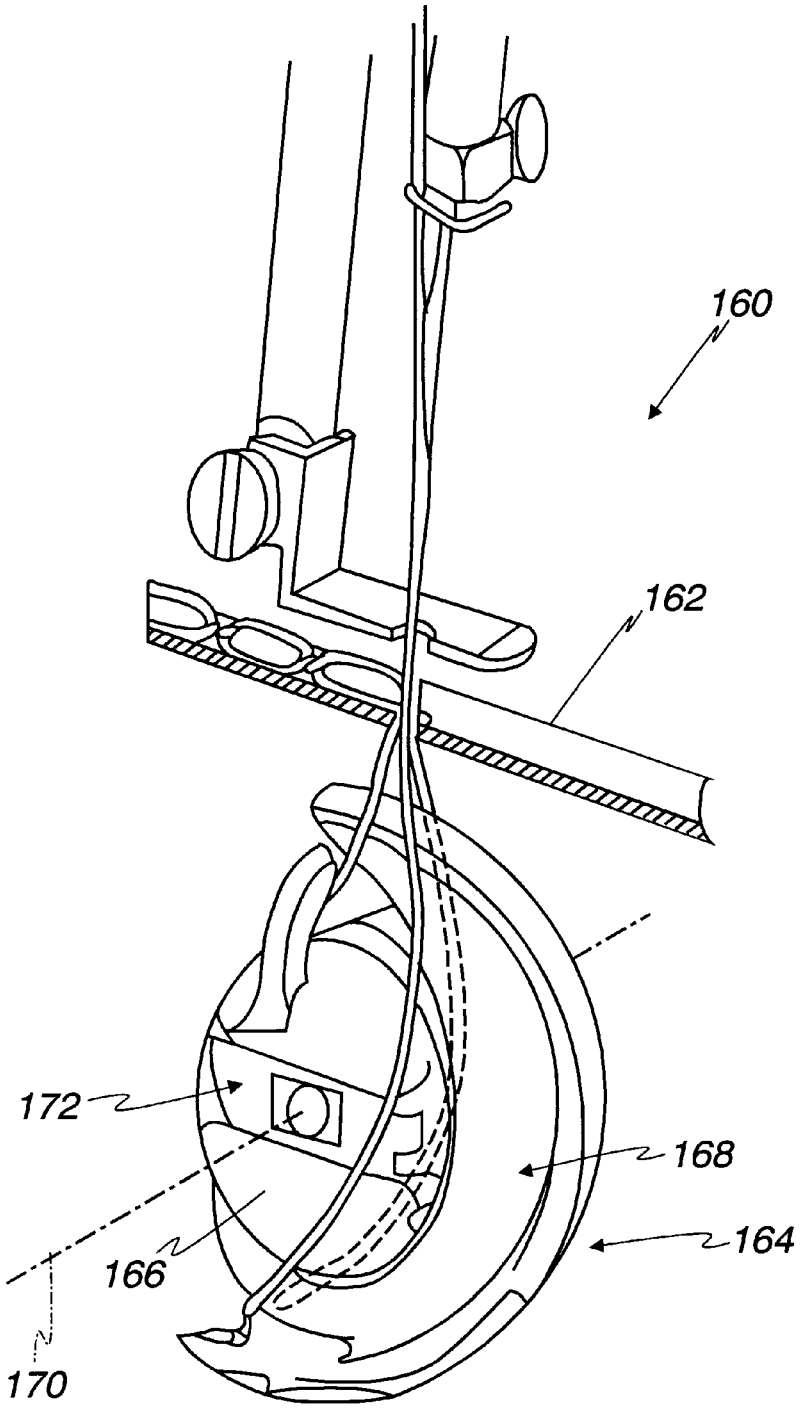
FIG. 9 is a fragmentary, perspective view of a sewing machine with a shuttle-type hook system with a bobbin case assembly, according to the present invention, incorporated therein.

In FIG. 9 a part of a sewing machine is shown at 160 in the process of stitching a piece of material 162. A shuttle-type hook system at 164 has a bobbin case assembly 166, according to the present invention, incorporated therein and mounted to a hook assembly at 168. The hook assembly 168 is movable in an oscillatory path relative to the bobbin case assembly 166 around an axis 170. The operation of this type of hook system 164 is described more fully in my copending application Ser. No. 09/010,888, referenced above.

The bobbin case assembly 166 may have the same constitution and construction as any of the bobbin case assemblies shown in, and described with reference to, FIGS. 1–8, above. A latch system 172 may likewise have the constitution and construction of any of the latch systems shown in, and described with reference to, FIGS. 1–8.

It is not necessary that a latch system, such as those previously described, be utilized to maintain the bobbin case assemblies in their operative positions. As one alternative, it is known to use cooperating magnets on a bobbin case assembly and one of a hook assembly and bobbin basket assembly to releasably maintain a bobbin case assembly in an operative position.

The foregoing disclosure of specific embodiments is intended to be illustrative of the broad concepts comprehended by the invention.

What is claimed is:

1. A hook system comprising:

a hook assembly having a first operating axis;

a bobbin basket assembly which is mounted to the hook assembly for movement relative to the hook assembly around the first operating axis; and a bobbin case assembly which is mounted to and separable from the bobbin basket assembly and defines a receptacle for a bobbin, the bobbin case assembly comprising a peripheral wall extending around the first operating axis and a confining wall extending from the peripheral wall, the peripheral wall and confining wall having a combined mass, with at least 50% of the combined mass of the peripheral wall and confining wall being made from a non-metal material.

2. The hook system according to claim 1 wherein the bobbin basket assembly and bobbin case assembly cooperatively define the receptacle for a bobbin.

3. The hook system according to claim 1 wherein substantially the entirety of the combined mass of the peripheral wall and confining wall is made from a non-metal material.

4. The hook system according to claim 1 wherein the bobbin case assembly further comprises a thread holding spring element attached to the peripheral wall of the bobbin case assembly.

5. The hook system according to claim 4 wherein the spring element is made from metal.

6. The hook system according to claim 4 wherein the spring element is curved and wraps around a part of the peripheral wall of the bobbin case assembly.

7. The hook system according to claim 6 wherein the spring element is attached to the peripheral wall and has a finger which projects into one of the peripheral wall and confining wall.

8. The hook system according to claim 1 wherein the non-metal material comprises plastic.

9. The hook system according to claim 1 wherein the non-metal material comprises polyketone.

10. The hook system according to claim 1 wherein the bobbin case assembly further comprises a latch system including a latch element that is movable relative to the peripheral and confining walls between a) a latched position wherein the latch element maintains the bobbin case assembly operatively connected to the bobbin basket assembly and b) an unlatched position wherein the bobbin case assembly can be selectively assembled to and separated from the bobbin basket assembly.

11. The hook system according to claim 10 wherein the latch element is made from metal.

12. The hook system according to claim 10 wherein the latch system comprises a latch actuator that is pivotable to change the latch element from the latched position into the unlatched position, and the latch element actuator is made from metal.

13. The hook system according to claim 10 wherein the latch element is translatable between the latched and unlatched positions.

14. The hook system according to claim 1 wherein the peripheral wall and confining wall each have a thickness and the entire thickness of at least a part of at least one of the peripheral wall and confining wall is made from the non-metal material.

15. The hook system according to claim 1 wherein at least a part of at least one of the peripheral wall and confining wall made form the non-metal material is made by injection molding.

16. A bobbin case assembly that can be separably connected to a hook assembly, said bobbin case assembly comprising:

a peripheral wall extending around a first operating axis; and a confining wall extending radially relative to the first operating axis from the peripheral wall, the peripheral wall and confining wall having a combined mass, with at least 50% of the combined mass of the peripheral wall and confining wall being made from a non-metal material.

17. The bobbin case assembly according to claim 16 wherein substantially the entirety of the mass of the peripheral wall and confining wall is made from a non-metal material.

18. The bobbin case assembly according to claim 16 wherein the non-metal material comprises polyketone.

19. The bobbin case assembly according to claim 16 wherein the bobbin case assembly further comprises a latch system including a latch element that is movable relative to the peripheral and confining walls between a) a latched position wherein the latch element is capable of maintaining the bobbin case assembly operatively connected to a hook assembly and b) an unlatched position wherein the bobbin case assembly can be selectively assembled to and separated from a hook assembly.

20. The bobbin case assembly according to claim 19 wherein the latch element is made from metal.

21. The bobbin case assembly according to claim 19 wherein the latch element is made from a non-metal material.

22. The bobbin case assembly according to claim 21 wherein the peripheral wall has an axial extent parallel to the first operating axis and the bobbin case assembly further comprises a curved spring element which wraps around a part of the peripheral wall of the bobbin case assembly and extends over at least one half of the axial extent of the peripheral wall.

23. The bobbin case assembly according to claim 16 wherein there is a wear element embedded in the non-metal material with the wear element being made from a material that is harder than the non-metal material to avoid thread wear in operation.

24. The bobbin case assembly according to claim 16 wherein the bobbin case assembly further comprises a thread holding spring element which wraps around a part of the peripheral wall of the bobbin case assembly and there is a track on the peripheral wall extending radially with respect to the first rotary axis to facilitate confining of thread between the peripheral wall and spring element.

25. The bobbin case assembly according to claim 16 wherein the peripheral wall has axially spaced ends and there is a thread receiving opening extending fully through the peripheral wall that is located approximately mid-way between the axially spaced ends of the peripheral wall.

26. The bobbin case assembly according to claim 25 wherein there is a slot extending through the peripheral wall from one axially spaced end to the thread receiving opening, and the slot does not extend significantly past the thread receiving opening toward the other axially spaced end of the peripheral wall.

* * * * *